US007862309B2

(12) United States Patent
Chen et al.

(10) Patent No.: US 7,862,309 B2
(45) Date of Patent: Jan. 4, 2011

(54) THIN FAN STRUCTURE

(75) Inventors: Chao-Ching Chen, Fengshan (TW); Mag Chen, Pingtung (TW)

(73) Assignee: Adda Corporation, Pingtung (TW)

( * ) Notice: Subject to any disclaimer, the term of this patent is extended or adjusted under 35 U.S.C. 154(b) by 0 days.

(21) Appl. No.: 11/822,705

(22) Filed: Jul. 9, 2007

(65) Prior Publication Data

US 2009/0016914 A1 Jan. 15, 2009

(51) Int. Cl.
*F04B 35/04* (2006.01)
*F03B 1/00* (2006.01)

(52) U.S. Cl. ..... 417/423.12; 417/423.7; 417/423.14; 417/423.15; 417/424.1; 415/220; 415/229

(58) Field of Classification Search ..... 417/423.12, 417/423.7, 423.14, 423.15, 424.1; 310/90, 310/156.32; 415/220, 229
See application file for complete search history.

(56) References Cited

U.S. PATENT DOCUMENTS 3,553,510 A * 1/1971 Howey ..... 310/156.72
4,725,752 A * 2/1988 Shiraki et al. ..... 310/268
RE37,261 E * 7/2001 Schmider et al. ..... 417/423.7
6,270,325 B1 * 8/2001 Hsieh ..... 417/423.12
7,259,484 B2 * 8/2007 Hosono ..... 310/51
7,474,032 B2 * 1/2009 Horng et al. ..... 310/268
2005/0265864 A1 * 12/2005 Hsieh ..... 417/423.8
2007/0114869 A1 * 5/2007 Horng et al. ..... 310/156.32
2007/0164624 A1 * 7/2007 Horng et al. ..... 310/90

* cited by examiner

*Primary Examiner*—Devon C Kramer
*Assistant Examiner*—Christopher Bobish
(74) *Attorney, Agent, or Firm*—Muncy, Geissler, Olds & Lowe, PLLC

(57) ABSTRACT

A thin fan structure is composed of a driving unit and a rotating unit. The driving unit has a base, a coil circuit board and a shaft, in which the coil circuit board is disposed at the base. The rotating unit has a bearing, a fan blade, an iron-containing metal sheet and a magnet, in which the bearing has an outer ring and an inner ring. The fan blade, the iron-containing metal sheet and the magnet are fixed at the outer ring of the bearing, the inner ring of the bearing is fixed at the shaft of the driving unit and the coil circuit board of the driving unit is able to drive the rotating unit turning around.

20 Claims, 5 Drawing Sheets

THIN FAN STRUCTURE

FIELD OF THE INVENTION

The present invention is relating to a fan structure, more particularly to an improved thin fan structure.

BACKGROUND OF THE INVENTION

Referring to FIG. 1, a known fan structure 10 mainly comprises a casing 11, a bearing 12, a shaft 13, a fan blade 14, a stator 15, a silicon steel sheet 16 and a magnet 17. The casing 11 has a shaft seat 11*a*, the bearing 12 has an outer ring 12*a* fixed on the shaft seat 11*a* and an inner ring 12*b*. The shaft 13 penetrates and is fixed at the inner ring 12*b* of the bearing 12 and the fan blade 14 is fixed at one end of the shaft 13. The stator 15 is disposed on the shaft seat 11*a* of the casing 11, the silicon steel sheet 16 and the magnet 17 are fixed on an inside wall 14*a* of the fan blade 14. When the fan structure 10 is actuated, the inner ring 12*b* of the bearing 12, the shaft 13, the fan blade 14, the silicon steel sheet 16 and the magnet 17 start to rotate simultaneously. The known fan structure 10 is no longer applied for miniaturized or thinned electronic products that have been made in recent years because which has a thick and heavy structure entirely.

SUMMARY OF THE INVENTION

It is therefore an object of the invention to provide a thin fan structure for resolving the above-described problem. The disclosed fan comprises a driving unit and a rotating unit. The driving unit has a base, a coil circuit board disposed on the base and a shaft. The rotating unit has a bearing, a fan blade, an iron-containing metal sheet and a magnet, wherein the bearing has an outer ring and an inner ring, the fan blade, the iron-containing metal sheet and the magnet are fixed at the outer ring of the bearing, the inner ring of the bearing is fixed at the shaft of the driving unit, and the coil circuit board of the driving unit is able to drive the rotating unit to turn around. In accordance with the present invention, length of the shaft may be substantially shortened by integrating the bearing, the fan blade, the iron-containing metal sheet and the magnet into a rotating unit and the coil circuit board may flat the stator to widely decrease thickness and weight of entire fan structure, thereby improving the fan structure in lightness, thinness and smallness as required as well as effectively widening applicable area.

A thin fan structure in accordance with the present invention comprises a driving unit and a rotating unit, in which the driving unit has a base, a coil circuit board disposed on the base and a shaft, the rotating unit has a bearing, a fan blade, an iron-containing metal sheet and a magnet. The bearing has an outer ring and an inner ring, wherein the fan blade, the iron-containing metal sheet and the magnet are fixed at the outer ring of the bearing, the inner ring of the bearing is fixed at the shaft of the driving unit, and the coil circuit board of the driving unit serves to drive the rotating unit turning around.

Another thin fan structure in accordance with the present invention comprises a driving unit and a rotating unit, in which the driving unit has a coil circuit board and a shaft, the rotating unit has a bearing and a rotor. The bearing has an outer ring and an inner ring and the rotor at least has a fan blade and a magnet, wherein the rotor is fixed at the outer ring of the bearing, the inner ring of the bearing is fixed at the shaft of the driving unit, and the coil circuit board of the bearing can drive the rotating unit turning around.

DETAILED DESCRIPTION OF THE INVENTION

Figure 1:
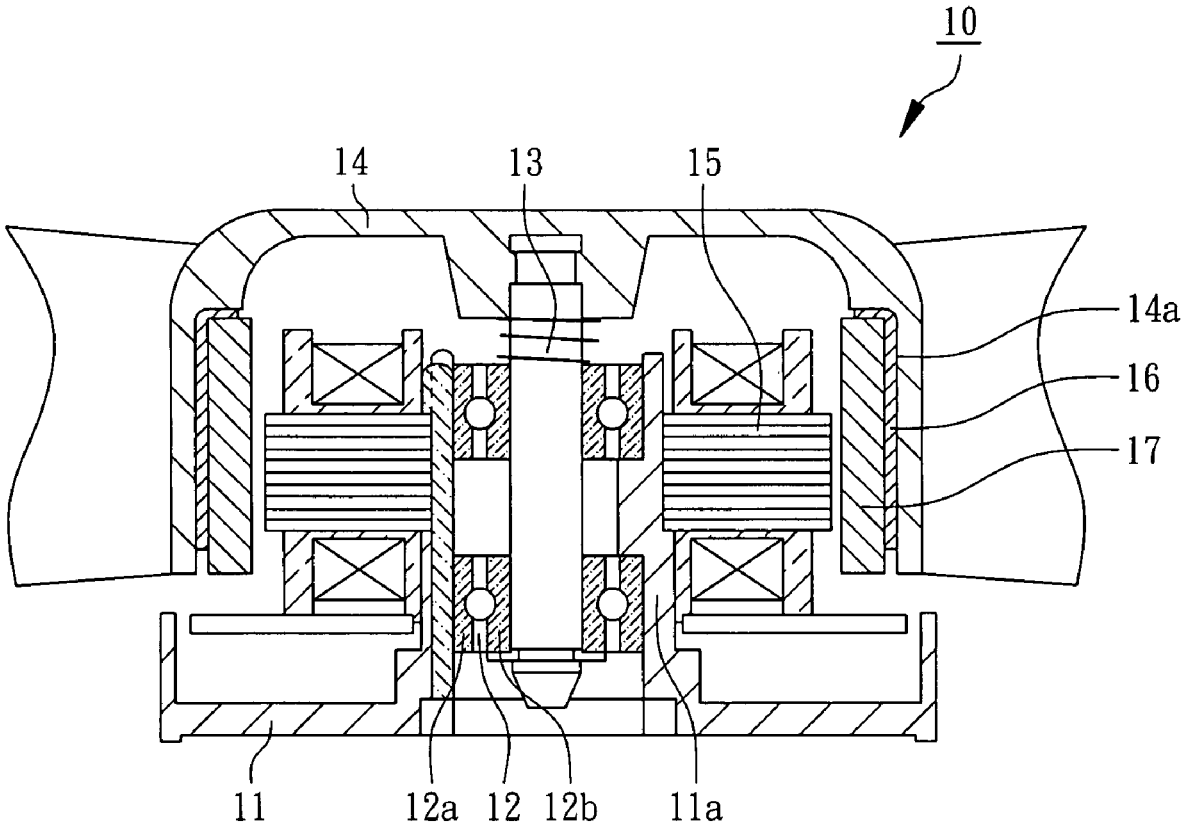
FIG. 1 PRIOR ART
FIG. 1 shows a view of a known fan structure.
Figure 2:
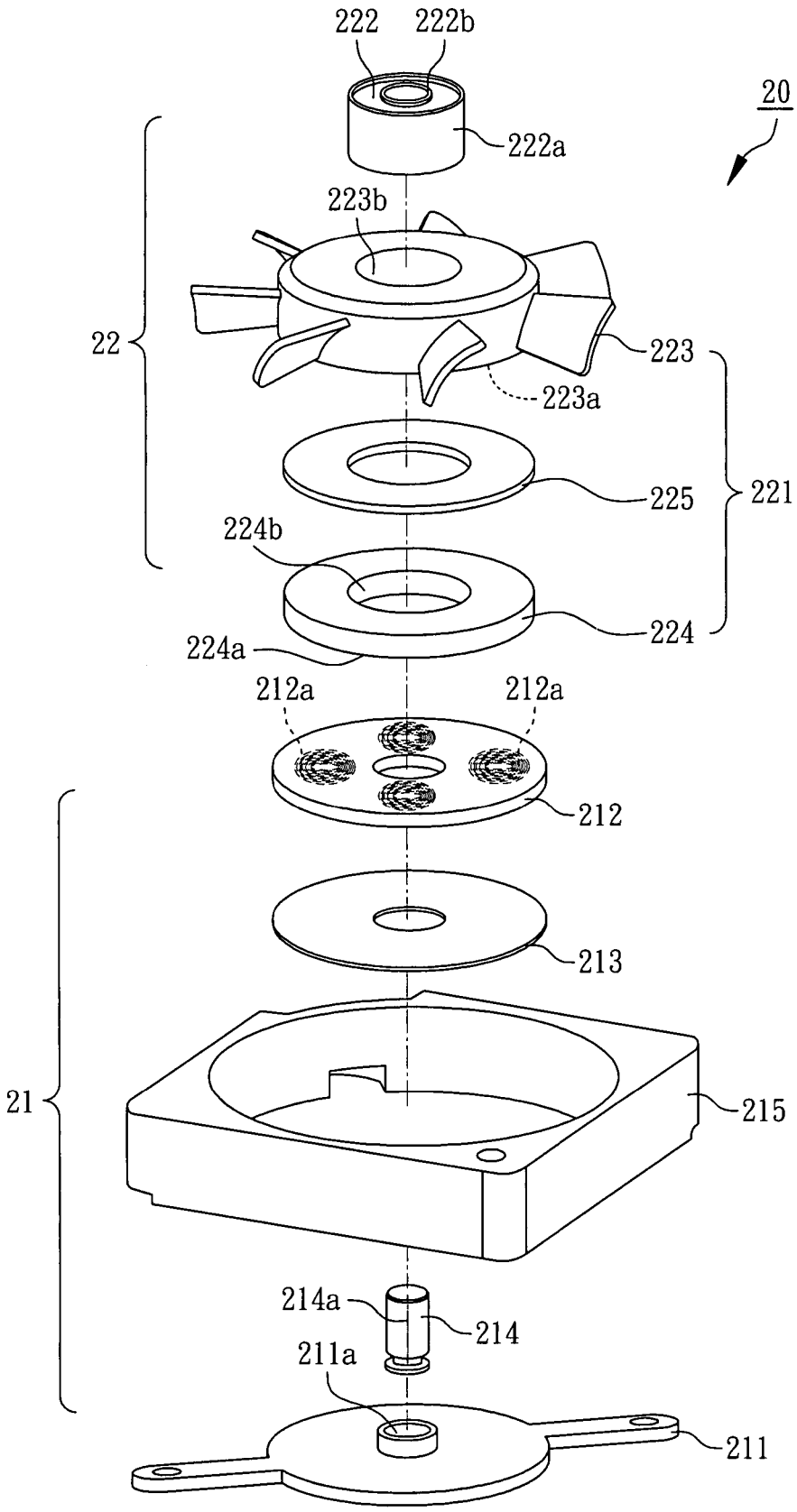
FIG. 2 shows an exploded perspective view of a thin fan structure in accordance with a first preferable embodiment of the present invention.
Figure 3:
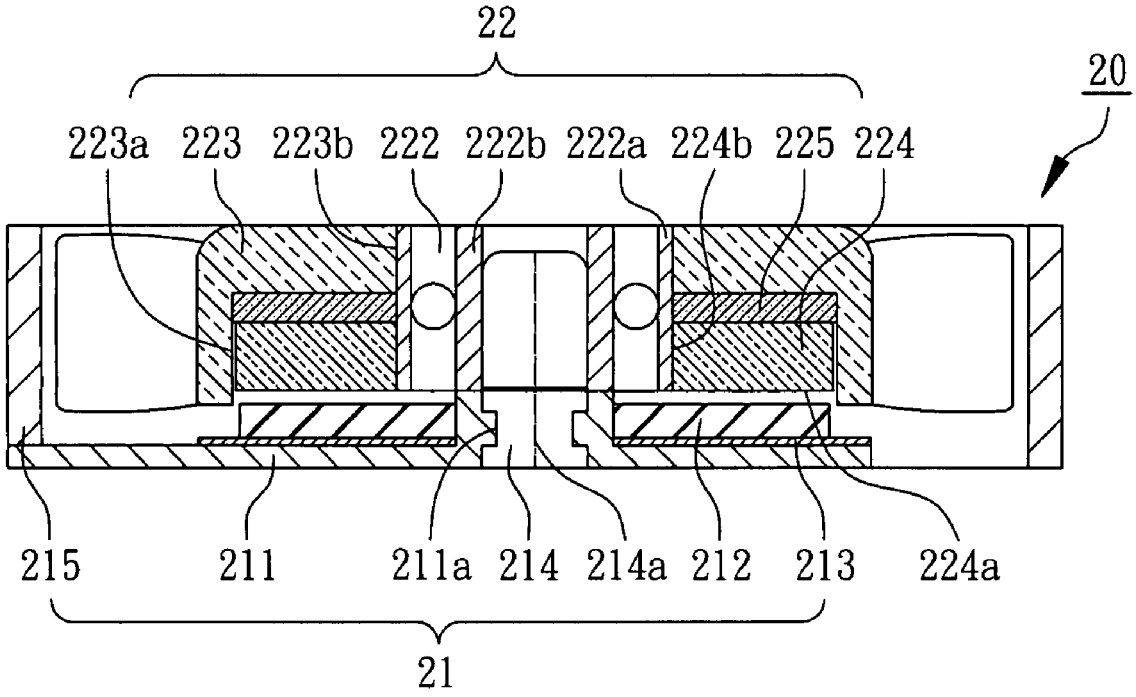
FIG. 3 shows an assembly cutaway view of the thin fan structure in accordance with the first preferable embodiment of the present invention.

With reference to FIG. 2 and 3, a thin fan structure 20 is disclosed in accordance a first preferable embodiment of the present invention comprising a driving unit 21 and a rotating unit 22. In this embodiment, the driving unit 21 has a base 211, a coil circuit board 212, an insulation sheet 213 and a shaft 214, in which the base 211 may be formed with a metal and preferably with an iron-containing metal, the coil circuit board 212 is disposed on the base 211 and has a built-in coil winding 212*a* to drive the rotating unit 22 turning around, the insulation sheet 213 is disposed between the base 211 and the coil circuit board 212 so as to prevent the coil circuit board 212 from contacting the base 211 that causes a short circuit probably. It is preferable to integrate the insulation sheet 213 and the coil circuit board 212 into an integral, otherwise, the insulation sheet 213 can be saved while the base 211 is not metal. In this embodiment as shown in FIG. 3, the shaft 214 is fixed at the base 211 and preferably the base 211 has a fixing groove 211*a* to dispose the shaft 214. With reference again to FIGS. 2 and 3, the rotating unit 22 comprises a rotor 221 at least having a fan blade 223 and a magnet 224 and a bearing 222, in which the magnet 224 has a magnetizing surface 224*a* and a lateral 224*b*. In this embodiment, the rotor 221 further has an iron-containing metal sheet 225 made with a soft magnet material and preferably the iron-containing metal sheet 225 is a silicon steel sheet. The fan blade 223 has a cavity 223*a* and a central aperture 223*b* communicating with the cavity 223*a*. In this embodiment, the magnet 224 and the iron-containing metal sheet 225 are disposed in the cavity 223*a* of the fan blade 223, the magnetizing surface 224*a* of the magnet 224 faces the coil circuit board 212 and is perpendicular to a central line 214*a* of the shaft 214. The bearing 222 is disposed in the central aperture 223*b* of the fan blade 223 and has an outer ring 222*a* and an inner ring 222*b*. The rotor 221 is fixed at the outer ring 222*a* of the bearing 222 and the inner ring 222*b* of the bearing 222 is fixed at the shaft 214 of the driving unit 21. In this embodiment as shown in FIG. 3, the rotor 221 is fixed at the outer ring 222*a* of the bearing 222, which means the fan blade 223, the magnet 224 and the iron-containing metal sheet 225 are fixed at the outer ring 222*a* of the bearing 222. In another embodiment, any one of the fan blade 223, the magnet 224 and the iron-containing metal sheet 225 may replace the rotor 221 to be fixed at the outer ring 222*a* of the bearing 222, otherwise, the bearing 222 can be integrally formed with the rotor 221. While the coil circuit board 212 starts to drive the driving unit 22 turning around, the inner ring 222*b* of the bearing 222 is fixed at the shaft 214 so that the outer ring 222*a* of the bearing 222, the fan blade 221, the iron-containing metal sheet 225 and the magnet 224 will rotate simultaneously. Besides, in this embodiment with reference again to FIGS. 2 and 3, the driving unit 21 further has an outer frame 215 to fix the base 211 of the driving unit 21 and the rotating unit 22 is disposed in the outer frame 215.

Figure 4:
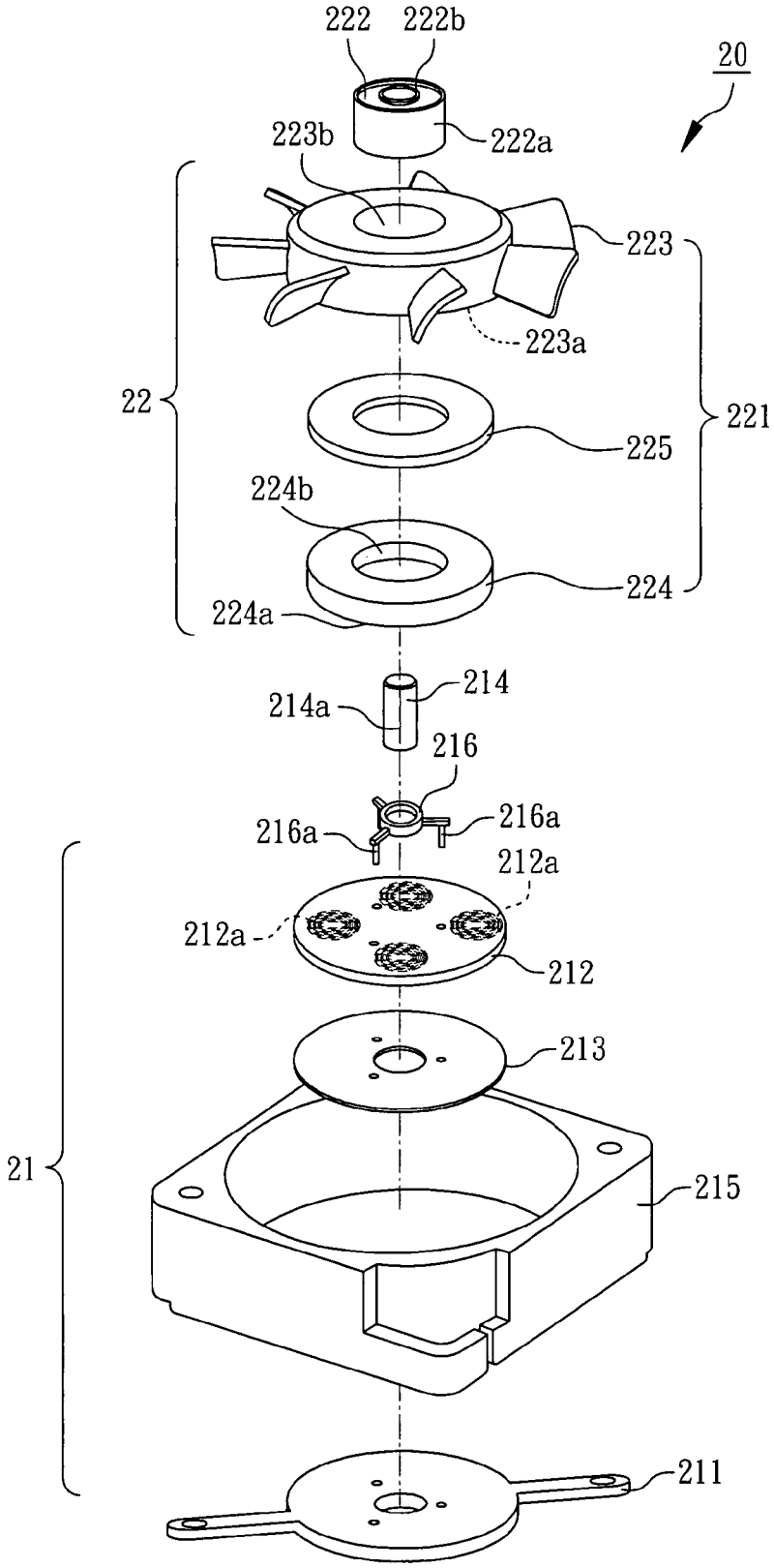
FIG. 4 shows an exploded perspective view of a thin fan structure in accordance with a second preferable embodiment of the present invention.
Figure 5:
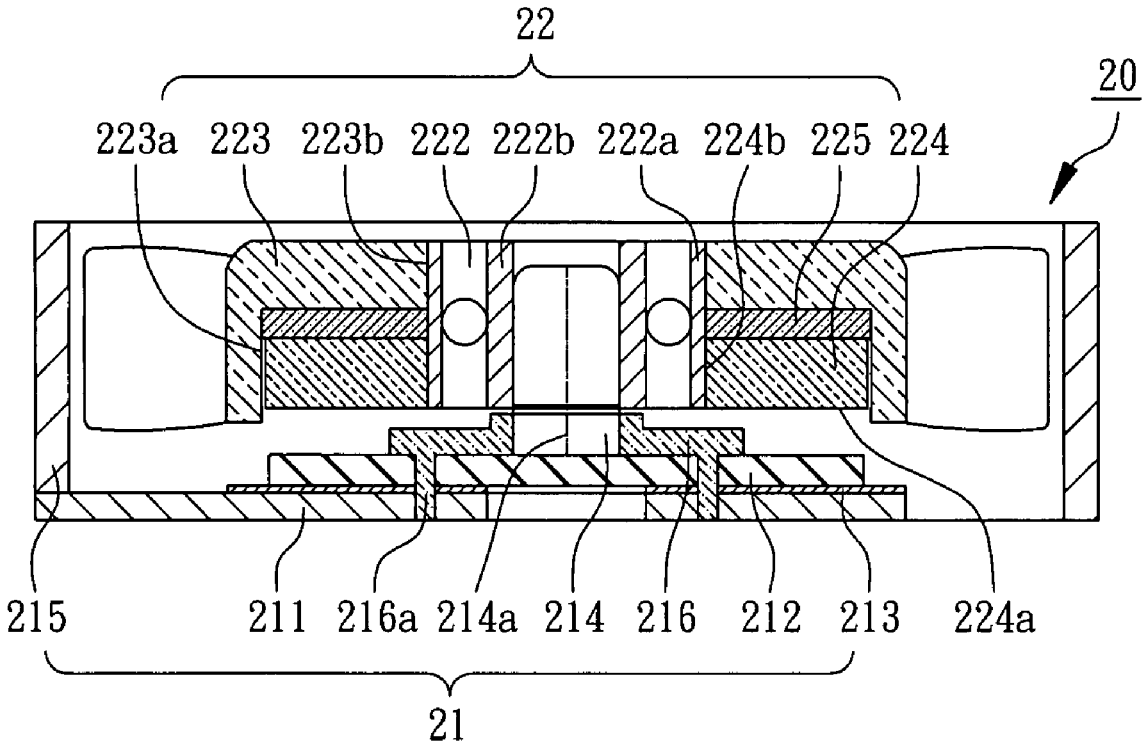
FIG. 5 shows an assembly cutaway view of the thin fan structure in accordance with the second preferable embodiment of the present invention.

With reference to FIGS. 4 and 5, a second preferable embodiment of the present invention discloses a thin fan structure 20, which comprises a driving unit 21 and a rotating unit 22. In this embodiment, the thin fan structure 20 is basically as same as that disclosed in the first preferable embodiment except that the driving unit 21 further has a shaft frame 216 disposed on the coil circuit board 212 and the shaft 214 is fixed at the shaft frame 216. In this embodiment, there is no need to further form an opening at central portion of the coil circuit board 212, which enables to widely increase circuit layout area of the coil circuit board 212. Moreover, the shaft frame 216 has a plurality of position pillars 216*a* that penetrate and are fixed at the coil circuit board 212 and the base 211.

As a result, the bearing 222, the fan blade 223, the magnet 224 and the iron-containing metal sheet 225 are integrated into a rotating unit 22 allowing length of the shaft 214 to be substantially shortened and the coil circuit board 212 may flat the stator to widely decrease thickness and weight of entire fan structure, thereby improving the fan structure in lightness, thinness and smallness as required as well as effectively widening applicable area.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A thin fan structure comprising:

a driving unit having a base, a coil circuit board disposed on the base and a fixed shaft; and a rotating unit having a bearing, a fan blade, a magnet and an iron-containing metal sheet, wherein the bearing has an outer ring and an inner ring, the fan blade, the magnet and the iron-containing metal sheet are fixed at the outer ring of the bearing, the inner ring of the bearing is fixed at the shaft of the driving unit and the coil circuit board of the driving unit may drive the rotating unit to turn around, the fan blade having a cavity containing the iron-containing metal sheet and the magnet so as to be effectively integrated and reducing an axial thickness;

the fan blade, the magnet and the iron-containing metal sheet each having a surface simultaneously engaging and being in direct contact with the outer ring of the bearing to increase contact area with the bearing and raise mechanical strength.

2. The thin fan structure in accordance with claim 1, wherein the driving unit further has an insulation sheet disposed between the base and the coil circuit board.

3. The thin fan structure in accordance with claim 1, wherein the shaft is fixed at the base.

4. The thin fan structure in accordance with claim 1, wherein the driving unit further has a shaft frame disposed on the coil circuit board and the shaft is fixed at the shaft frame.

5. The thin fan structure in accordance with claim 4, wherein the shaft frame has a plurality of position pillars that penetrate and are fixed at the coil circuit board.

6. The thin fan structure in accordance with claim 1, wherein the magnet has a magnetizing surface that faces the coil circuit board and is perpendicular to a central line of the shaft.

7. The thin fan structure in accordance with claim 1, wherein the fan blade has a central aperture for disposing the bearing.

8. The thin fan structure in accordance with claim 1, wherein the iron-containing metal sheet is a silicon steel sheet, wherein the driving unit further has an insulation sheet disposed between the base and the coil circuit board and wherein the driving unit further has a shaft frame disposed on the coil circuit board and the shaft is fixed at the shaft frame.

9. A thin fan structure comprising:

a driving unit having a coil circuit board and a fixed shaft; and a rotating unit having a bearing and a rotor, wherein the bearing has an outer ring and an inner ring, the rotor at least has a fan blade and a magnet, the rotor is fixed at the outer ring of the bearing, the inner ring of the bearing is fixed at the shaft of the driving unit and the coil circuit board of the driving unit may drive the rotating unit to turn around, the fan blade having a cavity containing the magnet so as to be effectively integrated and reducing an axial thickness;

the fan blade and the magnet each having a surface simultaneously engaging and being in direct contact with the outer ring of the bearing to increase contact area with the bearing and raise mechanical strength.

10. The thin fan structure in accordance with claim 9, wherein the driving unit further has a base to dispose the coil circuit board.

11. The thin fan structure in accordance with claim 10, wherein the driving unit further has an insulation sheet disposed between the base and the coil circuit board.

12. The thin fan structure in accordance with claim 10, wherein the shaft is fixed at the base.

13. The thin fan structure in accordance with claim 12, wherein the base has a fixing groove to dispose the shaft.

14. The thin fan structure in accordance with claim 9, wherein the driving unit further has a shaft frame disposed on the coil circuit board and the shaft is fixed at the shaft frame.

15. The thin fan structure in accordance with claim 14, wherein the shaft frame has a plurality of position pillars that penetrate and are fixed at the coil circuit board.

16. The thin fan structure in accordance with claim 9, wherein the magnet has a magnetizing surface that faces the coil circuit board and is perpendicular to a central line of the shaft.

17. The thin fan structure in accordance with claim 9, wherein the fan blade has a central aperture for disposing the bearing.

18. The thin fan structure in accordance with claim 9, wherein the rotor is fixed by means of fixing the fan blade at the outer ring of the bearing.

19. The thin fan structure in accordance with claim 9, wherein the rotor is fixed by means of fixing the magnet at the outer ring of the bearing.

20. The thin fan structure in accordance with claim 9, wherein the rotor further has an iron-containing metal sheet and is fixed by means of fixing the iron-containing metal sheet at the outer ring of the bearing.

* * * * *